US008662114B2

(12) United States Patent
Meinzinger

(10) Patent No.: US 8,662,114 B2
(45) Date of Patent: Mar. 4, 2014

(54) DEVICE AND METHOD FOR LOSS-FREE FILLING OF CONTINUOUSLY-MIXED MEDIA IN CONTAINERS

(75) Inventor: Rupert Meinzinger, Kirchroth (DE)

(73) Assignee: Krones AG, Neutraubling (DE)

( * ) Notice: Subject to any disclaimer, the term of this patent is extended or adjusted under 35 U.S.C. 154(b) by 0 days.

(21) Appl. No.: 12/909,825

(22) Filed: Oct. 21, 2010

(65) Prior Publication Data

US 2011/0108155 A1 May 12, 2011

(30) Foreign Application Priority Data

Oct. 22, 2009 (DE) ..... 10 2009 050 388

(51) Int. Cl.
*B65B 3/04* (2006.01)
*B67C 3/00* (2006.01)

(52) U.S. Cl.
USPC ..... 141/9; 141/57; 141/94; 141/95; 141/144; 141/145; 141/146; 141/198

(58) Field of Classification Search
USPC ..... 141/94, 146, 192, 198, 260, 295, 144, 141/145, 57, 95, 105, 9
See application file for complete search history.

(56) References Cited

U.S. PATENT DOCUMENTS

| | | | | |
|---|---|---|---|---|
| 2,168,380 A | | 8/1939 | Winton | |
| 2,621,845 A | * | 12/1952 | Meyer | 251/120 |
| 3,128,915 A | | 4/1964 | Matter | |
| 3,848,645 A | * | 11/1974 | Franz | 141/117 |
| 5,865,225 A | * | 2/1999 | Weiss | 141/198 |
| 6,470,922 B2 | * | 10/2002 | Sindermann | 141/37 |
| 6,595,245 B1 | | 7/2003 | Stagni | |
| 7,409,971 B2 | * | 8/2008 | Bonatti et al. | 141/9 |
| 7,469,726 B2 | * | 12/2008 | Clusserath et al. | 141/57 |
| 2009/0236007 A1 | * | 9/2009 | Clusserath et al. | 141/9 |

FOREIGN PATENT DOCUMENTS

| | | | | |
|---|---|---|---|---|
| DE | 4038890 | * | 12/1990 | 141/144 |
| DE | 40 38 890 A1 | | 6/1991 | |
| DE | 299 17 605 U1 | | 2/2000 | |
| EP | 0 262 483 A1 | | 4/1988 | |
| EP | 0 615 947 A1 | | 9/1994 | |
| EP | 1 156 965 B1 | | 11/2001 | |
| WO | 94/06303 | | 3/1994 | |
| WO | 00/46103 A2 | | 8/2000 | |

OTHER PUBLICATIONS

German Search Report, Apr. 12, 2010.

* cited by examiner

*Primary Examiner* — Timothy L Maust
*Assistant Examiner* — Timothy P Kelly
(74) *Attorney, Agent, or Firm* — Novak Druce Connolly Bove + Quigg LLP

(57) ABSTRACT

A device for loss-free filling of continuously mixed media in containers may include a mixing tank, a filler valve, and a connecting line. The mixing tank serves to receive and mix at least two different media, of which at least one medium is a fluid, and has a closing device for closing an outlet from the mixing tank. The filler valve serves for filling the mixed media from the mixing tank in the containers. The connecting line is arranged between the outlet from the mixing tank and the filler valve. Here the closing device has a ventilation line that can be connected with the connecting line to ventilate the connecting line to the filler valve. Also a plant may include such a device and a transport device for transporting the containers to the filler valve of the device.

15 Claims, 6 Drawing Sheets

DEVICE AND METHOD FOR LOSS-FREE FILLING OF CONTINUOUSLY-MIXED MEDIA IN CONTAINERS

CROSS-REFERENCE TO RELATED APPLICATION

This application claims the benefit of priority of German Patent Application No. 10 2009 050 388.9, filed Oct. 22, 2009, pursuant to 35 U.S.C. 119(a)-(d), the disclosure of which is incorporated herein by reference.

TECHNICAL FIELD

The present disclosure relates to a device and a method for loss-free filling of continuously-mixed media into containers and, in particular, filling of continuously-mixed drinks into containers. The disclosure is directed, in particular, at a device for filling multi-component drinks, for example drinks composed of a syrup and a watery medium. It is however pointed out that the present disclosure can also be applied to other devices for filling drinks and also other fluids such as milk, fruit juice, soft drinks, or oils or more viscous media.

BACKGROUND

Devices for filling fluids and, in particular, drinks have been known from the prior art for some time. In such devices for filling drinks, according to the prior art within the company of the applicant, the in-line proportioning of different media and its filling are physically separated, whereby a connecting line is required between the in-line proportioning and the filling, which cannot be filled without losses.

FIG. 6 shows such a device 100 with a product feed tank 105 in which filling product is added via a supply line 110 and where applicable via a media twist distributor in order to be filled at regular intervals through filler valves 155 arranged on the periphery of the device in container 200. The filling product can be composed of one or more components. Usually the products supplied to the product feed tank 105 are already mixed in the supply line or in a mixer not shown (in-line mixing) and where applicable pasteurised or sterilised by means of a heat exchanger and then supplied to the product feed tank 105 simply via a supply line. In the product feed tank 105 for example the mixing ratio of the two different components is 1+1.

The product feed tank 105 is connected with the filling devices 150 via connecting lines 130. In the connecting lines 130, means (not shown) can be arranged for measuring the filled product quantity e.g. inductive flow meters. The filling device 150 has a filler valve 155. The filler valve 155 is filled with fluid from the mixing tank 105 via connecting line 130. The fluid present in the filler valve 155 can be filled into suitable containers 200 by opening and closing the valve cone of filler valve 155.

In such a device 100 shown in FIG. 6, the problem exists that residue present in the product feed tank 105 and in the connecting line 130 between product feed tank 105 and filling device 150 cannot be filled loss-free into containers 200. This means that if a new filling product is to be added to the product feed tank 105, e.g. with a mixing ratio different from a first product, a residual fluid with the old mixing ratio, for example 1+1, still remains in connecting line 130 between the product feed tank 105 and the filling device 150 as shown in FIG. 6.

The residual fluid with the old mixing ratio, here 1+1, present in the product feed tank 105 and in the connecting line 130 between the product feed tank 105 and the filling device 150, must be drained from the connecting line 130 before the fluid with the new mixing ratio, for example 2+1, can be filled by the filling device 150. For this reason firstly there is always a certain loss of mixed fluid which could be avoided. Secondly in each case there is a certain interruption of the filling process between fluids with different mixing ratios and hence an undesirable time loss in the filling process.

WO 94/06303 shows a method for production of a consumer milk with a defined fat content in packaging. Here two-components are mixed which have milk products but have different fat contents. According to an embodiment the two parts are mixed directly in the packaging. According to another embodiment the two parts are mixed in a separate mixing step immediately before filling into the packaging, in that predetermined quantities of the two-components are mixed which correspond to the size of the packaging or multiples of the packaging.

It may be desirable to provide a device and a method which can fill a continuously mixed product comprising at least two different media loss-free into containers.

SUMMARY

According to various aspects of the disclosure, a device comprises a mixing tank for receiving and mixing at least two different media, of which at least one medium is a fluid and has a closing device for closing a outlet from the mixing tank, a filler valve for filling the mixed media from the mixing tank into the containers, a connecting line between the outlet from the mixing tank and the filler valve and a ventilation device for ventilating the connecting line to the filler valve.

In some aspects, the ventilation device is a ventilation line which can be connected with the connecting line for the closing device to ventilate the connecting line to the filler valve.

It may be desirable for the outlet to be formed funnel-shaped and the closing device to have a closing body with an at least partly conical portion, which cooperates with the funnel-shaped outlet in a wall of the mixing tank for closing the mixing tank.

It is also possible that the at least partly conical portion of the closing body has at least one recess surrounding the at least partly conical portion, which recess is arranged vertical to the cone axis of the at least partly conical portion.

The closing device is, in some aspects, at least partly a hollow body which is hollow along the axis of the conical portion and can be used for the ventilation line.

In addition the hollow body can be fitted with two ventilation openings to ventilate the cavity in the hollow body.

It may be desirable if one of the two ventilation openings is arranged outside the mixing tank on the closing device.

It is also possible that the device comprises a mixing tank fill level detector to detect the fill level of the mixing tank, a container fill level detector to detect the fill level of a container filled by the filler valve, and a control device to control the closing device of the mixing tank on the basis of a detection result from the mixing tank fill level detector and/or a detection result from the container fill level detector. A container fill level detector is sufficiently known to the person skilled in the art and can for example be formed as an electric sensor on the filler valve or as an inductive flow meter in the connecting line.

The control device can be structured such that it closes the outlet from the mixing tank by means of the closing device when the control device determines, on the basis of a detection result from the container fill level detector, that a predetermined filling quantity is present in the container which is also the nominal fill level of the container less the filling quantity present in the connecting line and the filler valve.

Also the control device can be structured such that it opens the filler valve and ventilates the connecting line and filler valve by means of the ventilation line of the closing device when the outlet from the mixing tank is closed by means of the closing device.

It is conceivable that the device described above is part of a plant which comprises a transport device to transport the containers to the filler valve, where further container production and processing machines known to the person skilled in the art can be arranged upstream and downstream.

According to some aspects of the disclosure, a method for loss-free filling of continuously mixed media in containers can be performed by means of a device which comprises a mixing tank for receiving and mixing at least two different media, of which at least one medium is a liquid, a filler valve for filling the mixed media from the mixing tank into the containers, and a connecting line between the outlet from the mixing tank and the filler valve, and the steps comprise: continuous supply of at least two different media, of which at least one medium is a fluid, to a mixing tank, closure of the outlet on the mixing tank with a closure device, ventilation of the connecting line and the filler valve by means of a ventilation device for ventilating the connecting line to the filler valve, opening and closing the filler valve to fill the containers.

In some aspects, the method may also comprise the steps: detection of a fill level of a container to be filled and closure of the outlet from the mixing tank with the closing device when it is determined, on the basis of a detection result from the fill level detection step, that a predetermined filling quantity is present in the container which is equal to the nominal fill level of the container less the filling quantity present in the connecting line and the filler valve.

It may be desirable if the method comprises the step of production of a new mixing ratio of the media in the mixing tank by the supply of only one of the at least two different media to the mixing tank when the outlet from the mixing tank is closed by the closing device.

The steps can also comprise: opening the outlet from the mixing tank with the closing device, and opening and closing the filler valve in a cycle with which containers are transported to the filler valve.

According to the construction described above of the devices, there is a dependency of the different parts of the device for loss-free processing of the merged media.

The mixing tank is designed and arranged such that with a remaining volume of filling product, it can be blocked and its discharge line, which is the connecting line mentioned above, can be fully drained into the filling device. The filling device itself is designed such that a remaining volume in its storage tank can be blocked and the line to the filler valve and the filler valves in the container can be fully evacuated.

The blocking facility and the targeted supply and discharge of the product mixed from at least two different media in the mixing tank allow the setting of new mixing ratios for loss-free switching between products of different mixing ratios in the subsequent product residue.

Some further advantages and embodiments may become evident from the attached drawings.

DETAILED DESCRIPTION

Figure 1:
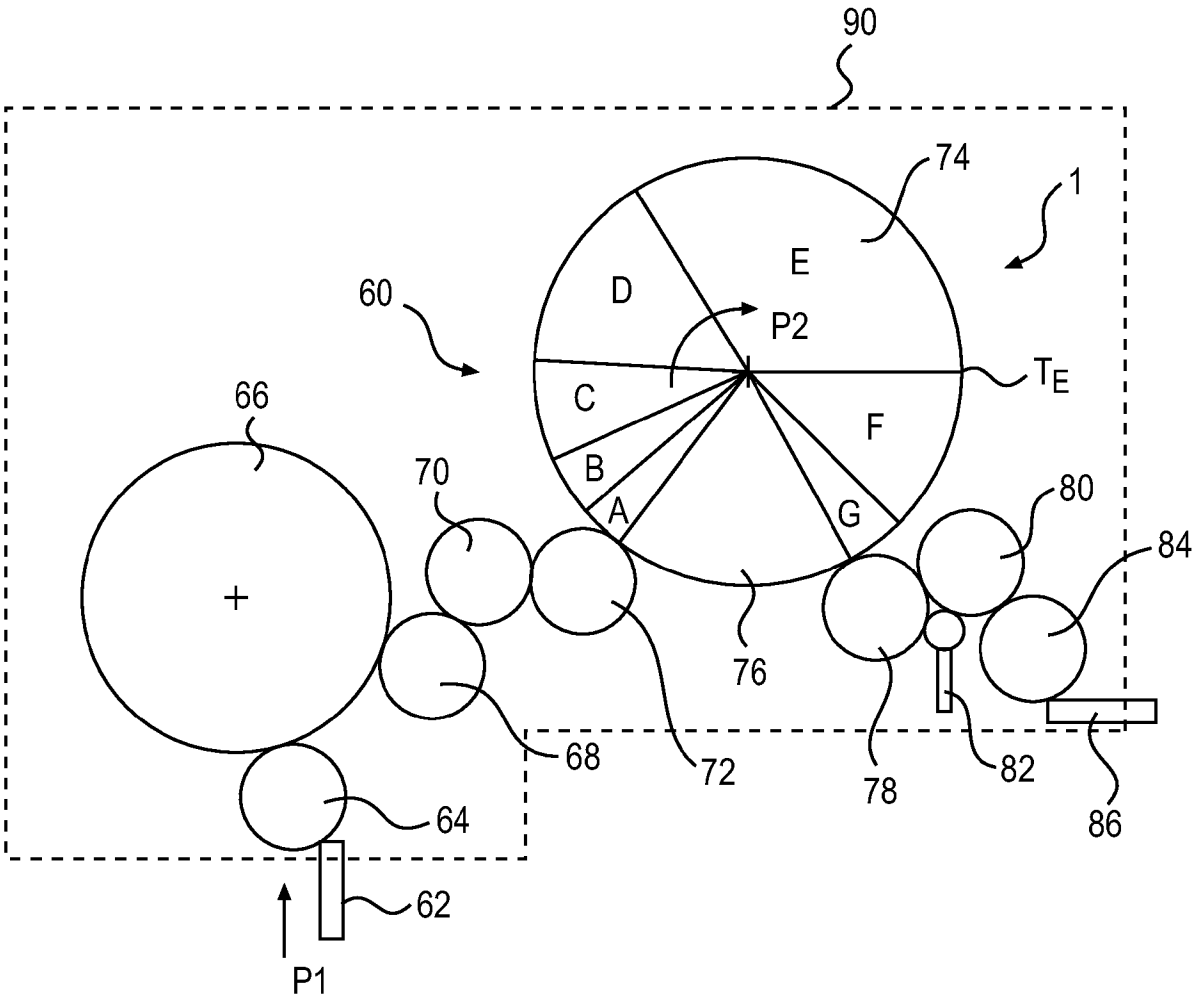
FIG. 1 is a diagrammatic view of an exemplary plant for filling drinks containers in accordance with various aspects of the disclosure.

FIG. 1 shows a diagrammatic view of a plant 60 for filling containers. This plant 60 has a container supply 62 which along arrow P1 supplies containers via an inlet star-wheel 64 to a flushing device 66 or a rinser.

The reference numeral 68 relates to an outlet star-wheel of the rinser 66 which takes over the rinsed containers and delivers these via a transfer star-wheel 70 and a filler inlet star-wheel 72 to a device 1 for filling with drinks. The device 1 here fills the two-component drinks. Reference numerals A to G designate different process steps which are run in the direction of arrow P2 on filling of drinks. In a step A the container is delivered to a filler device and transported out of the area of delivery. In a step B the container is pressed onto a filler valve. In a step C pre-tensioning take place where the containers are pressurised with a gaseous medium, for example carbon dioxide. In a step D the containers are filled with a filling product, such as for example a carbonised drink, at a high filling speed. In a step E the containers are filled with the same filling product but at a low filling speed. Reference numeral $T_E$ designates the end of filling the container with the drink.

In a step F the filled drink can be left to rest or the pressure relieved and in step G the container is removed from the filler device.

Reference numeral 78 relates to an outlet star-wheel of device 1 and reference numeral 80 to a closing device in order to close the containers with closures, wherein reference numeral 82 relates to a feed device for the container closures. Reference numeral 84 indicates an outlet star-wheel from the closing machine and reference numeral 86 a discharge device to transport away the filled containers.

Reference numeral 76 designates a dead point in which no containers are filled or no containers are arranged at corresponding filling stations.

Figure 2:
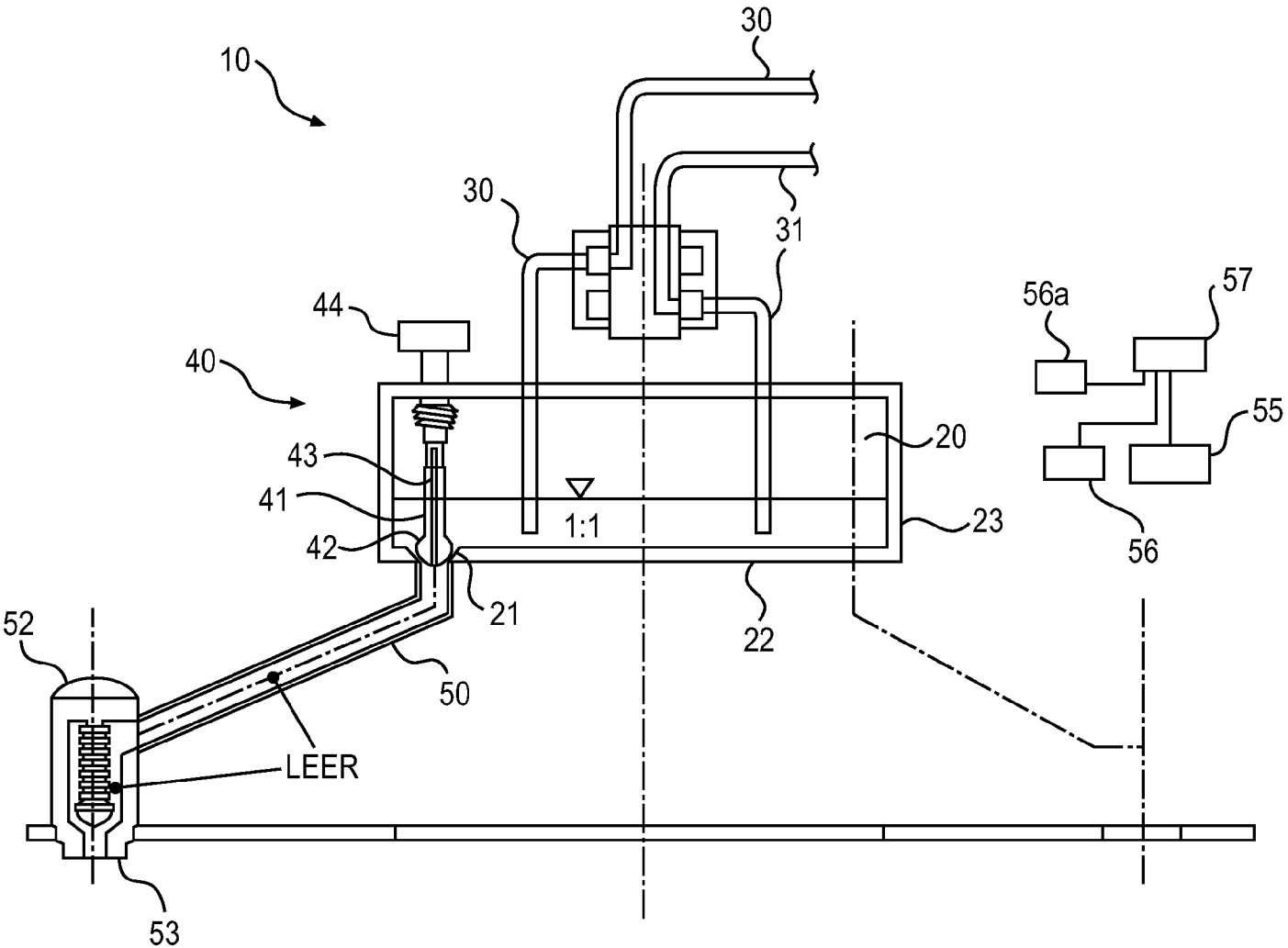
FIG. 2 is a diagrammatic cross-section view of an exemplary device for loss-free filling of continuously mixed fluids of the plant in FIG. 1.

FIG. 2 shows a diagrammatic cross-section view of a device 10 for loss-free filling of continuously mixed fluids of plant 60 in FIG. 1. The device 10 has a mixing tank 20 in which at least different media, in particular two different fluids, are filled via two separate distribution tracks or a first supply line 30 and a second supply line 31. The two different media are mixed together in the mixing tank 20 either actively i.e. with a mixing tool for example an agitator not shown, or passively i.e. by movement of the fluids themselves. This means that the two different media are not mixed by in-line mixing. The first and second supply lines 30, 31 can be blocked separately via shut-off valves not shown. In the mixing tank 20, as an example of a mixing ratio of two different media, a mixing ratio of 1+1 is given.

As FIG. 2 shows, the mixing tank 20 at its base has an outlet 21 which is closed by means of a closing device 40. Through this the drainage of fluid from the mixing tank 20 into a connecting line 50 to a filling device 52 can be suppressed. At the mixing tank, several outlets 21 can be arranged, in some aspects, regularly distributed at the same distances from each other. For the sake of simplicity in FIGS. 2, 4 and 5, only one outlet 21 is drawn.

The closing device 40 has a closing body 41 with a conical portion 42. The conical portion 42 is connected with a rod-like portion 43 which is arranged along the cone axis K (see FIG. 3) of the conical portion 42 at the conical portion 42. Also the closing device has an adjustment mechanism 44 arranged above the mixing tank 20 and by means of which the closing device 40 can be moved vertically as shown in FIG. 2.

The filling device 52 has a filler valve 53. Filler valve 53 is filled with fluid from the mixing tank 20 through the connecting line 50 when the closing device 40 of the mixing tank 20 is at least partly opened. The fluid present in the filler valve 53 can be filled into suitable containers 54 by opening and closing the filler valve 53. In some aspects, the filler valve 53 is opened and closed in a cycle with which the containers 54 are delivered by a transport device comprising the container supply 62, inlet star-wheel 64, outlet star-wheel 68, transfer star-wheel 70 and filler inlet star-wheel 72, to the filler valve 53. In some aspects, this is the same cycle with which the containers 54 are transported by a transport device formed from the outlet star-wheel 78 and discharge device 86, away from the filler valve 53. The rinser 66 and closing device 80 here have a certain transport function which is not mentioned separately here in connection with the said transport devices.

Also the device comprises a mixing tank fill level detector 55 with which the fill level of mixing tank 20 can be detected and a container fill level detector 56 for detecting a fill level of a container 54 filled by a filler valve 53. The container fill level detector 56 can be arranged firstly in the container 54 filled or being filled or to be filled. Alternatively the container fill level device 56 can be arranged outside the container 54 filled or being filled or to be filled. Also a connecting line filler valve fill level detector 56*a* can be present which serves for detecting the fill level in the connecting line 50 and the filler valve 53.

For automatic control of the closing device 40, a control device 57 is provided. The control device 57 can be part of device 10 or part of plant 60 or a system above plant 60. The control device 57 serves in particular to control the closing device 40 of the mixing tank 20 on the basis of a detection result from the mixing tank fill level detector 55. The control device 57 can however also control the closing device 40 of the mixing tank 20 on the basis of a detection result from the container fill level detector 56 and/or the connecting line-fill valve fill level detector 56*a*. The control device 57 can also control the filler valve 53 and for example also the detection result from the mixing tank fill level detector 55 and/or the container fill level detector 56 and/or the connecting line filler valve fill level detector 56*a* can be used.

FIG. 2 shows the situation in which the mixing tank 20 is closed by means of the closing device 40 and the connecting line 50 and filler valve 53 are drained. To achieve this state the closing device 40 is designed as shown in FIG. 3.

Figure 3:
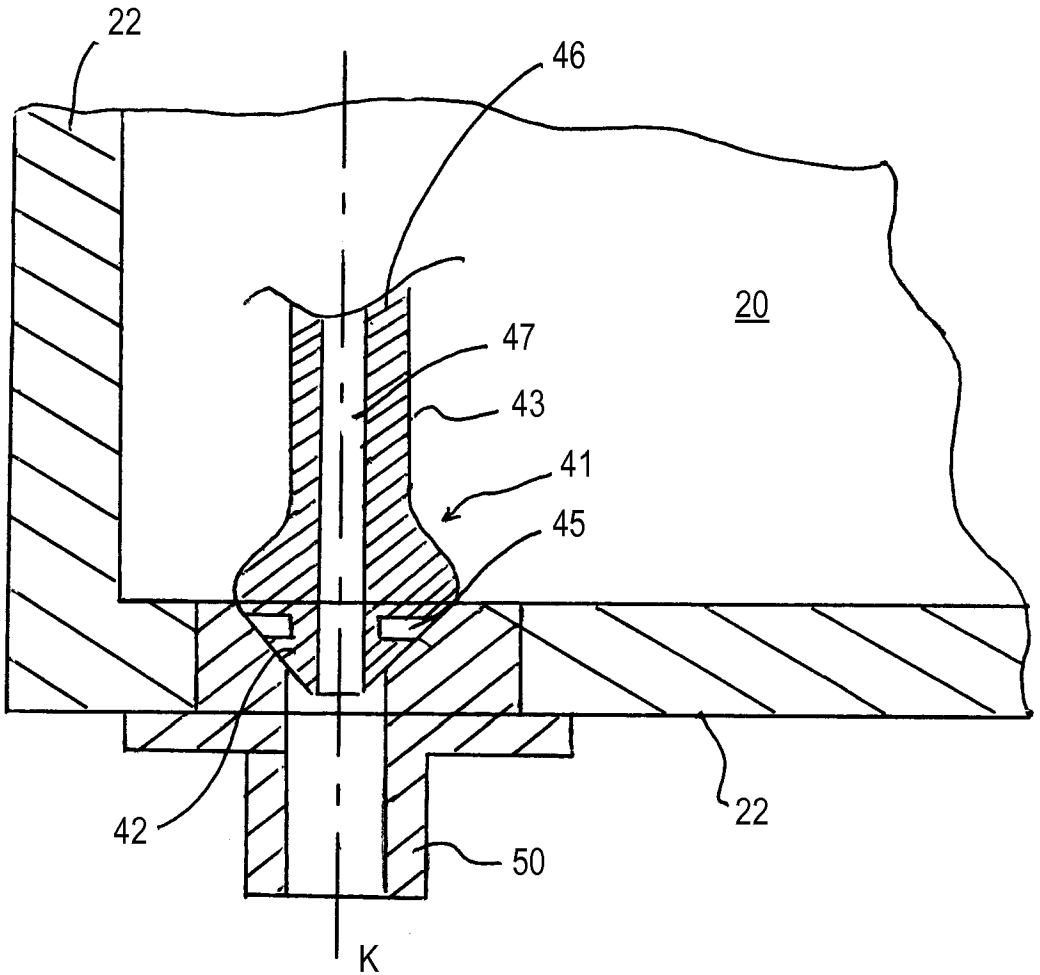
FIG. 3 is a diagrammatic cross-section view of an exemplary closing device of a mixing tank of the device shown in FIG. 2.

FIG. 3 illustrates the closing body 41 of the closing device 40 of the mixing tank 20 in cross-section.

The closing body 41 has a portion running towards a tip which forms part of the conical body 42. Horizontal to the cone axis of the conical portion 42, the conical portion 42 has a peripheral recess 45. In the recess can be inserted for example a sealing ring not shown. The conical portion 42 is connected with a rod-like portion 43 which is arranged along the cone axis K of the conical portion 42 on the conical portion 42. This means that cone axis K of conical portion 42 and the rod axis of the rod-like portion 43 converge or coincide. The conical portion 42 and the rod-like portion 43 have a cavity 46 along the cone axis K of conical portion 42 or the rod axis of rod-like portion 43. As a result the conical portion 42 in FIG. 3 is more precisely a truncated conical portion 42, since the tip of the cone of the conical portion 42 is not present due to the design of cavity 46 along the cone axis of the conical portion 42. The recess 45 running around the conical portion 42 is spaced at a predetermined distance from the truncated cone tip of the conical portion 42.

The cavity 46 can serve to hold a ventilation line 47 for ventilating the connecting line 50 and filler valve 53. The cavity 46 can however also itself form the ventilation line 47 for ventilating the connecting line 50 and filler valve 53.

The conical portion 42 of the closing device 40, which is designed conical at least in sections, is as described above inserted in the outlet 21 from the mixing tank 20 as shown in FIG. 3. Here the outlet 21 in FIG. 3 is formed funnel-shaped in the base 22 of the mixing tank 20. In some aspects, the outlet 21 is arranged at the lowest point of the mixing tank 20. The outlet 21 can however also be present in a side wall 23 of the mixing tank 20, for example just above the base 22 of the mixing tank 20.

Due to the described design of the closing device 40 and outlet 21, the pressure of the fluid in the mixing tank 20, which acts under the weight of the fluid on the base 22 of the mixing tank 20, pushes the conical portion 42 of the closing device 40 into the funnel-shaped outlet 21. For this the width of the recess 45 on the cone surface of the conical portion 42 is structured such that the conical portion 42 can effectively prevent the escape of fluid from the mixing tank 20 into the connecting line 50. This means that the width of the recess 45 on the cone surface of the conical portion 42 is, in some aspects, narrower than the length of the hopper funnel of the funnel-shaped outlet 21 which is formed between the inside of the base 22 of the mixing tank 20 and the connecting line 50. In this way a secure closure of the outlet 21 of the mixing tank 20 can be guaranteed.

The conical portion 42 and rod-like portion 43 can be made of one piece as shown in FIG. 3. It is however also possible that the conical portion 42 and rod-like portion 43 are made of at least two pieces which are connected together such that the cavities 46 in the conical portion 42 and the rod-like portion 43 are connected together and at the connecting point are sealed air-tight towards the outside. Alternatively a ventilation line 47 can be guided into the cavity 46 of the conical portion 42 and rod-like portion 43 so that the cavity 46 of the conical portion 42 and rod-like portion 43 need not be sealed airtight towards the outside at the connecting points between the conical portion 42 and rod-like portion 43.

It may be desirable if the ventilation line 47 leads out of the closing device 40 above the mixing tank 20 or is open above the mixing tank 20. Here the ventilation line 47 can be opened and closed under control at its end facing away from the truncated cone tip of the conical portion 42 with a closure not shown. On opening the closure of the ventilation line 47 at its end facing away from the truncated cone tip of the conical portion 42, ambient air flows into the ventilation line 47 so that the fluid still present in the connecting line 50 and filler valve 53 runs out of the filler valve 53 under gravity when the filler valve 53 is opened. However air can be actively blown into the ventilation line 47 for example by means of a compressed gas connection not shown.

Because of this design of the closing device 40, in such a device 10 in addition to the filler valve 53, the closing device 40 in the mixing tank 20 can be involved in the filling process of containers 54. Here when the container fill level detector 56 detects that the container 54 to be filled or just filled has been filled to a level which is equal to the maximum fill level of the container 54 or nominal fill level of container 54 less the fill quantity present in the connecting line 50 and filler valve 53, the closing device 40 in the mixing tank 20 is closed and the connecting line 50 ventilated. Closure of the closing device 40 can be controlled by means of control device 57 as stated above. The liquid volume or media volume present in the connecting line 50 can be determined in advance and for example stored in a storage device accessible to the control device 57.

Therefore residue present in the connecting line 50 between mixing tank 20 and filler valve 53 can be filled loss-free into container 54. This means that if a new mixing ratio is produced in the media introduced in the mixing tank 20, a remaining fluid with the old mixing ratio can be filled completely into the final container(s) 54 from the connecting line 50 between the mixing tank 20 and filling device 52. Thus on supply of fluid with the new mixing ratio to the filler valve 53, there is no residual fluid with the old mixing ratio left in connecting line 50 between mixing tank 20 and filler valve 53 and in filler valve 53. In this way filling of the fluid from the mixing tank 20 can also be carried out loss-free into mixing tank 20 even on a change of mixing ratio of the at least two media supplied to mixing tank 20.

Figure 6:
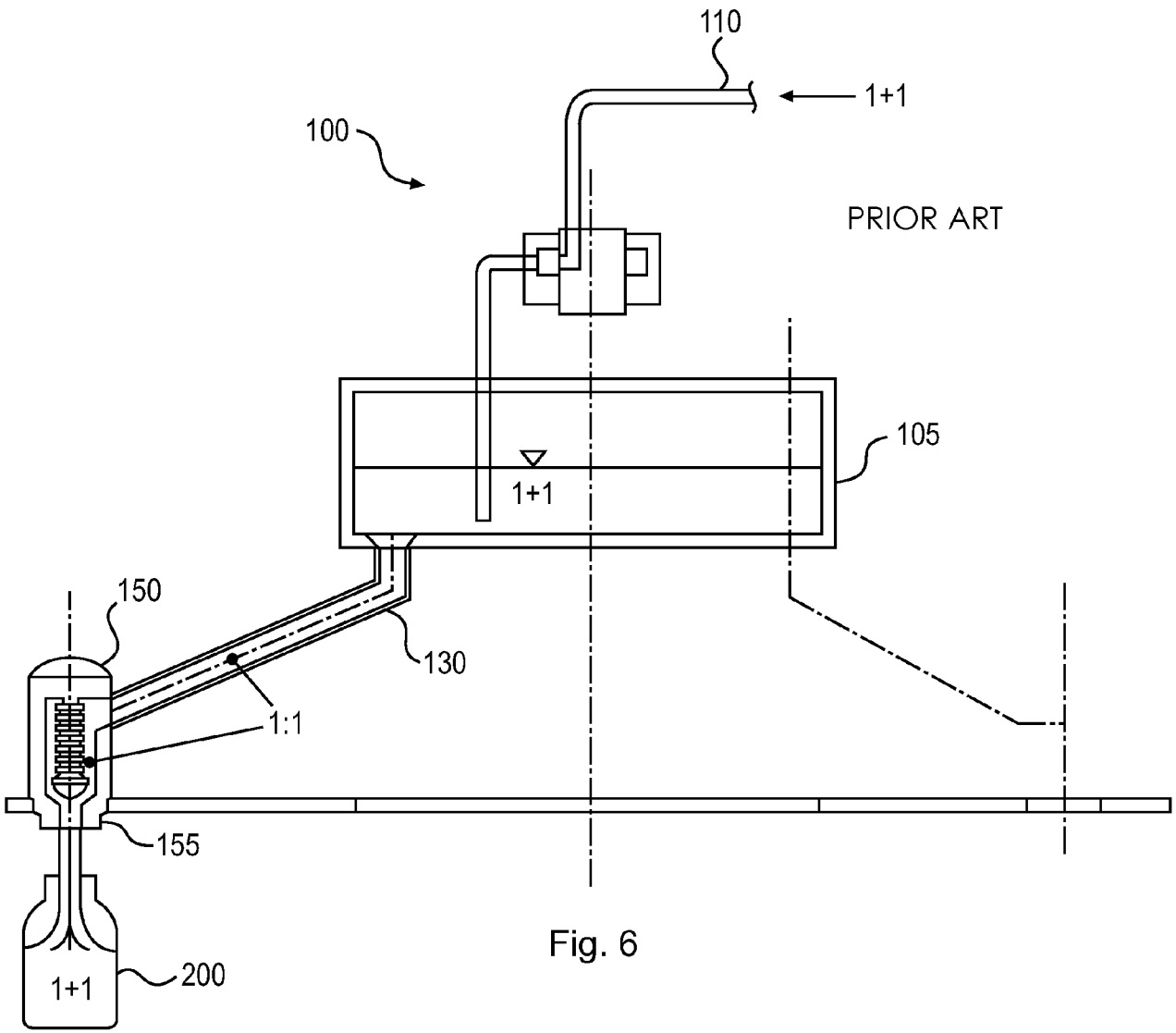
FIG. 6 is a cross-section view of a device for filling continuously mixed fluids according to the prior art.

The production of a new mixing ratio of media to be supplied to the mixing tank 20 via the first and second supply line 30, 31 and where applicable further supply lines, not shown here for the sake of simplicity, is described below with reference to FIGS. 2, 4 and 6. The production of the new mixing ratio of media can take place manually or using the control device 57. Control can take place again on the basis of a detection result of the mixing tank fill level detector 55.

First starting from a situation in which the outlet 21 from mixing tank 20 is not closed by means of closing device 40 but open, the filler valve can be opened and closed as required in order to fill successively delivered containers 54.

Next the outlet 21 of the mixing tank 20 must be closed by means of the closing device 40. The connecting line 50 between the mixing tank 20 and filler valve 53 can be drained, using an air supply or by ventilation by opening the ventilation line 47 of the closing device 40, into at least one container 54 arranged below the filler valve 53. The situation achieved now is shown in FIG. 2, where only the product with a mixing ratio of the two different media of 1+1 for example is present in the mixing tank 20.

More precisely, the product still contained in connecting line 50 and filler valve 53 during the regular filling operation is completely drained in relation to FIG. 2 or already completely filled into containers 54. This means that the last container filled by the filler valve 55 contains a defined volume from the mixing tank 20 and the complete volume from the product line 50 and filler valve 53. The total corresponds to the specified filling quantity. The specified filling quantity is the quantity filled in the other similar containers 54 which were filled directly before this on plant 60.

The remaining volume contained in mixing tank 20 is detected via the mixing tank fill level detector 55. Then in mixing tank 20, the outlet 21 of which is again closed by means of closing device 40, via unilateral product supply a new mixing ratio can be set in the mixing tank 20. This means that, as shown for example in FIG. 4, via the first supply line 30 half the quantity of the defined remaining volume which is still present in the mixing tank 20 in the situation shown in FIG. 2 is supplied to the mixing tank 20. In this way in the mixing tank 20 a mixing ratio is achieved of 2+1 of the media supplied from the first and second supply lines 30, 31 to mixing tank 20.

Figure 4:
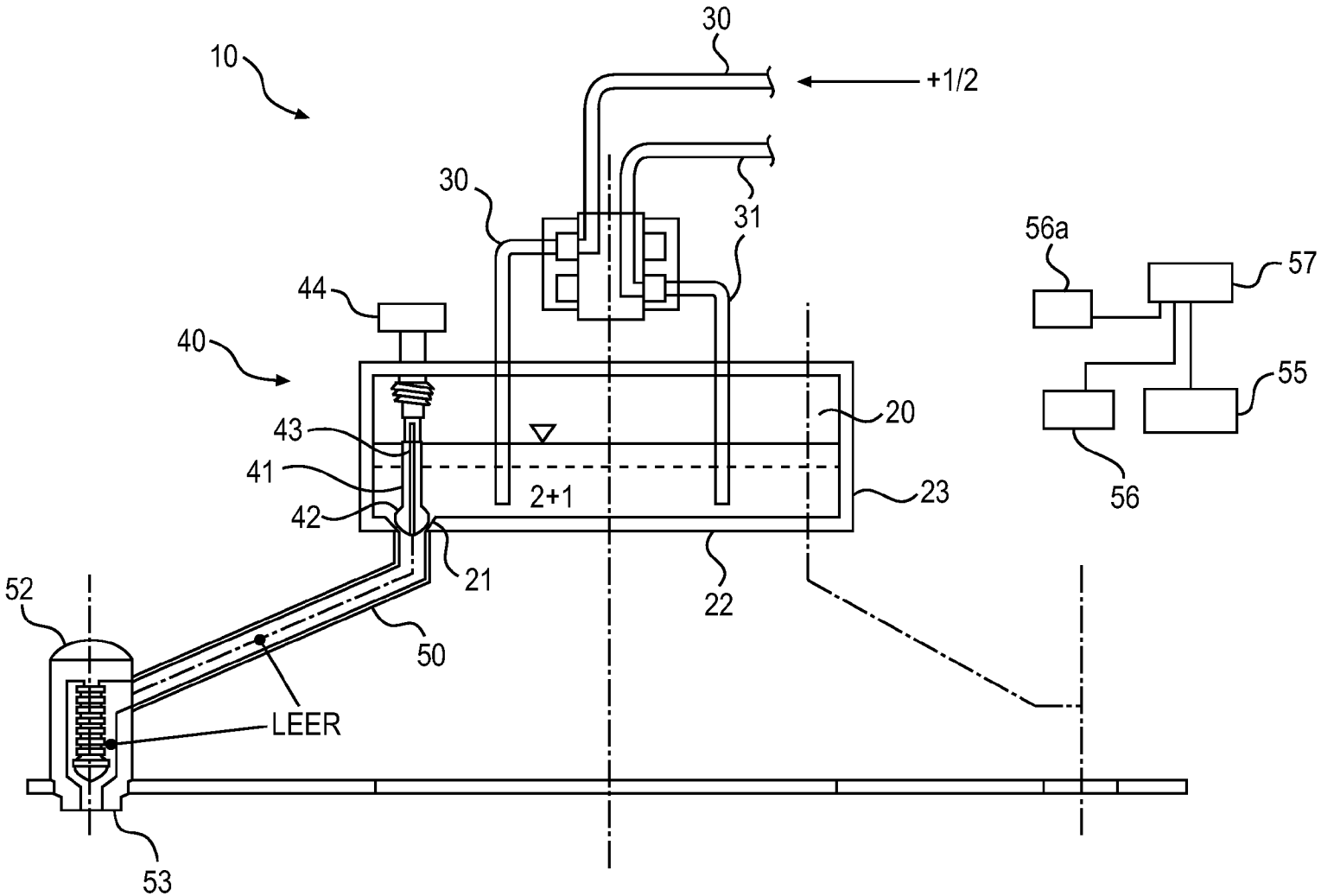
FIG. 4 is a further diagrammatic cross-section view of the exemplary device for loss-free filling of continuously mixed fluids.
Figure 5:
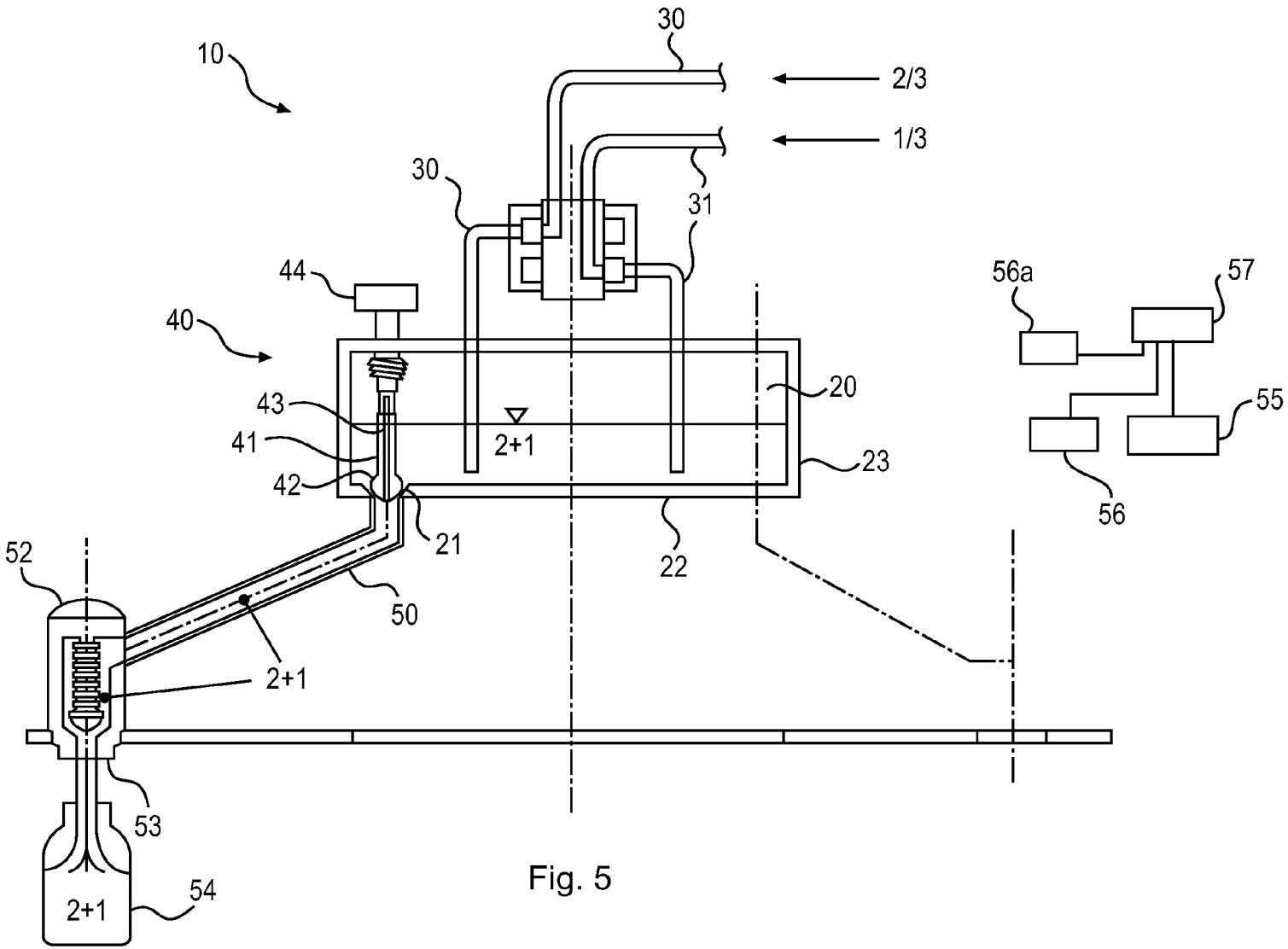
FIG. 5 is a further diagrammatic cross-section view of the exemplary device for loss-free filling of continuously mixed fluids.

As soon as the new mixing ratio of for example 2+1 as given in FIG. 4 is achieved for the product in mixing tank 20, the next container 54 which directly follows the last container 54 with the last fill of product with mixing ratio 1+1 can be filled with the product with the new mixing ratio of 2+1 which is now present in mixing tank 20. For this as shown in FIG. 5 the closing device 40 is opened again so that the product with the new mixing ratio of 2+1 can flow from mixing tank 20 into the connecting line 50 and the filler valve 53. When the filler valve 53 is opened, the product with the new mixing ratio of 2+1 can be filled in containers 54.

The control device 57 can for example determine that the new mixing ratio of for example 2+1 as given in FIG. 4 is achieved for the product in the mixing tank 20. The control device 57 can namely assess the defined remaining volume in the mixing tank 20 which is present after closing the outlet 21 by means of the closing device 40 and before the unilateral product supply to the mixing tank 20, in relation to a detection result of the mixing tank fill level detector 55 on unilateral product supply to the mixing tank 20. It can simply be determined from this when the new mixing ratio of for example 2+1 is achieved as given in FIG. 4.

After achieving the new mixing ratio, two different media with a mixing ratio of 2/3 to 1/3 are continuously supplied to the mixing tank 20, so that the device 10 and hence also the plant 60 can continue to work without interruption, via the first and second supply line 30, 31 into the mixing tank 20 as shown in FIG. 5. In this way the new mixing ratio of 2+1 can be maintained in mixing tank 20 as long as necessary.

If the mixing tank fill level detector 55 detects that a fill level of the mixing tank 20 is reached at which the mixing tank 20 threatens to overflow, the control device 57 switches off the supply of media via the first and second supply lines 30, 31 into the mixing tank 20 or blocks the supply. As soon as the mixing tank fill level detector 55 again detects an uncritical state in this regard, it allows the supply of media via the first and second supply lines 30, 31 into the mixing tank 20. These functions apply at all times during operation of device 10.

As soon as device 10 or the plant 60 has filled all containers 54 which are to be filled with the mixing ratio of 2+1 of the two media supplied by the first and second lines 30, 31 to the mixing tank 20, if necessary again another mixing ratio can be set in the mixing tank 20 similarly to the description above.

All embodiments of device 10 and the method and plant 60 described above can be used individually or in all possible combinations. In particular the following modifications are conceivable.

The device 10 shown in FIGS. 1 to 5 serves for mixing drinks of at least two or more different fluids. These fluids can for example be water, syrup and/or flavourings in predetermined mixing ratios per container volume to be filled.

Even where previously in connection with FIG. 1 a plant 60 for filling containers is described in which the method steps A to G described above are performed in succession, wherein the carbonised filling product consists of at least two different media which are mixed in the said mixing tank 20, the plant 60 can also fill a product consisting of at least two different media without carbonisation into containers 54. In this case the process steps B, C and F described above are omitted. Also the method steps D and E can be performed in reverse order or they can be performed several times in succession.

Even where previously only the ventilation line 47 is described as ventilation device for ventilating the connecting line 50 and filler valve 53, the ventilation of the connecting line 50 and filler valve 53 for draining the product still present in the connecting line 50 and filler valve 53 when the closing device 40 closes the outlet 21 from mixing tank 20 can also be performed via ventilation openings in the connecting line 50 not shown. Another ventilation line can be connected to this ventilation opening. In some aspects, the ventilation opening in the connecting line 50 is arranged close to the outlet 21 of the mixing tank 20, and has a closing device with which the ventilation line in the connecting line 50 can be opened and closed under control. Opening and closing the ventilation opening in connecting line 50 can again take place either manually or by means of control device 57.

The control device 40 can also be designed as a membrane valve below the mixing tank 20, wherein a closable ventilation opening is arranged below the membrane valve.

It is possible that the remaining quantity in the connecting line 50 and filler valve 53 after closure of mixing tank 20 with the closing device 40 still contains a fluid quantity which corresponds to an integral multiple of a quantity to be filled into the container 54. In such a case e.g. with very low volume bottles, the remaining quantity in the connecting line 50 and filler valve 53 after closure of mixing tank 20 with the closure device 40 can fill as many containers 54 as corresponds to the entirety of the integral multiple of the quantity to be filled in a container 54.

Even where previously a control device 57 is descried for automatic control of the closing device 40, control of the closing device 40 can take place manually for example by an operator. Here control of the closing device of mixing tank 20 can also take place on the basis of a detection result of a mixing tank fill level detector 55 and/or the container fill level detector 56 and/or the connecting line filler valve fill level detector 56*a*.

The filler device 52 can also have several filler valves which fill the product, mixed in the mixing tank from a storage vessel not shown for filling device 52, in containers 54.

The filler valve 53 like the closing device 40 of the mixing tank 20 can have a closing body 41 with an at least partly conical portion 42 and a rod-like portion which cooperates with a funnel-shaped opening in the valve base to close the filler valve 53.

The plant 60 for safety reasons has a machine protection 90 indicated in FIG. 1 as a dotted line. This machine protection can also be designed as a clean room using means known to the skilled person from the prior art. Thus and by further known means the device 10 or plant 60 can also be operated in a hygienic, up to an aseptic, working method.

In a further embodiment of disclosure the filling devices can be attached or flanged directly onto the mixing tank. As a result the connecting line is extremely short. An embodiment with filler device flanged onto the side of the mixing tank can be seen e.g. from EP 0615947 B1 FIG. 2. EP 0615947 B1 shows a ring boiler 2 which can serve as a mixing tank for the present disclosure. The connecting line between mixing tank and filling device or filler valve could be guided through an outlet in the ring boiler base directly to the side into the filling device (the filling element 3 in EP 0615947 B1). Thus the outlet could lie at the lower edge of the side wall of the ring boiler. It is important that the ring boiler can be discharged completely. The designs of a mixing tank mounted on the carousel of a filling machine as a ring boiler or central boiler are known to the specialist from the prior art so that he can select the correct design for the application concerned.

DE 29917605 U1 FIG. 1 shows a further installation possibility for a filler device according to the disclosure. Here a filler device is integrated directly into the floor of a container, according to the disclosure a mixing tank. In such an embodiment the components of the closing device on the floor of the mixing tank and the activation devices for the filler valve can be mounted, in some aspects, concentrically inside each other so that the functionality according to the disclosure can be achieved. The person skilled in the art will find simple methods of adapting the filler devices or filler valves shown in EP 0615947 B1 and DE 29917605 U1 in order to be used according to the disclosure.

It will be apparent to those skilled in the art that various modifications and variations can be made to the device and method for loss-free filling of continuously-mixed media into containers of the present disclosure without departing from the scope of the invention. Throughout the disclosure, use of the terms "a," "an," and "the" may include one or more of the elements to which they refer. Other embodiments of the invention will be apparent to those skilled in the art from consideration of the specification and practice of the invention disclosed herein. It is intended that the specification and examples be considered as exemplary only.

What is claimed is:

1. Device for loss-free filling of continuously mixed media in containers, comprising:

a mixing tank for holding and mixing at least two different media, of which at least one medium is a fluid, said mixing tank including a closing device for closing an outlet from the mixing tank;

a filler valve for filling containers with the mixed media from the mixing tank;

a connecting line between the outlet from the mixing tank and the filler valve;

a ventilation device for ventilating the connecting line to the filler valve;

a mixing tank fill level detector configured to detect a fill level of the media in the mixing tank;

a container fill level detector configured to detect a fill level of a container filled by the filler valve; and a control device configured to control the closing device of the mixing tank on the basis of a detection result of the mixing tank fill level detector and/or a detection result of the container fill level detector, the control device being structured such that it opens the filler valve and ventilates the connecting line and filler valve by means of the ventilation line of the closing device when the outlet from the mixing tank is closed by means of the closing device.

2. Device for loss-free filling of continuously mixed media in containers, comprising:

a mixing tank for holding and mixing at least two different media, of which at least one medium is a fluid, said mixing tank including a closing device for closing an outlet from the mixing tank, the closing device including a ventilation device extending therethrough;

a filler valve for filling containers with the mixed media from the mixing tank;

a connecting line between the outlet from the mixing tank and the filler valve;

the ventilation device being configured to ventilate the connecting line to the filler valve;

a mixing tank fill level detector configured to detect a fill level of the media in the mixing tank;

a container fill level detector configured to detect a fill level of a container filled by the filler valve; and a control device configured to control the closing device of the mixing tank on the basis of a detection result of the mixing tank fill level detector, and the control device being configured to control the closing device of the mixing tank on the basis of a detection result of the container fill level detector.

3. Device according to claim 2, wherein the ventilation device comprises a ventilation line connectable with the connecting line for the closing device to ventilate the connecting line to the filler valve.

4. Device according to claim 2, wherein the outlet is funnel-shaped, and the closing device includes a closing body with at least a partly conical portion, which cooperates with the funnel-shaped outlet on a wall of the mixing tank to close the mixing tank.

5. Device according to claim 4, wherein the at least partly conical portion of the closing body includes a recess which runs around the at least partly conical portion and is arranged vertical to the cone axis of the at least partly conical portion.

6. Device according to claim 2, wherein the closing device includes an at least partly hollow body, which is hollow along the axis of the conical portion is usable for the ventilation line.

7. Device according to claim 6, wherein the hollow body includes two ventilation openings to ventilate a cavity in the hollow body.

8. Device according to claim 7, wherein one of the two ventilation openings is arranged outside the mixing tank on the closing device.

9. Device according to claim 2, wherein the control device is structured and arranged so that it closes the outlet from the mixing tank by means of the closing device when the control device determines on the basis of a detection result from the container fill level detector that a predetermined filling quantity is present in the container which is also the nominal fill level of the container less the fill quantity present in the connecting line and filler valve.

10. Device according to claim 2, wherein the control device is structured such that it opens the filler valve and ventilates the connecting line and filler valve by means of the ventilation line of the closing device when the outlet from the mixing tank is closed by means of the closing device.

11. Method for loss-free filling of continuously mixed media in containers by means of a device comprising a mixing tank to receive and mix at least two different media, of which at least one medium is a fluid, a filler valve for filling the mixed media from the mixing tank into the containers, and a connecting line between the outlet from the mixing tank and the filler valve, the method comprising:

continuously supplying at least two different media, of which at least one medium is a fluid, to the mixing tank;

detecting a fill level of the media in the mixing tank with a mixing tank fill level detector;

detecting a fill level of a container filled by the filler valve with a container fill level detector;

closing an outlet from the mixing tank by means of a closing device;

controlling the closing device of the mixing tank by a control device, the control device being configured to control the closing device of the mixing tank on the basis of a detection result of the mixing tank fill level detector, the control device also being configured to control the closing device of the mixing tank on the basis of a detection result of the container fill level detector;

ventilating the connecting line and the filler valve by means of a ventilation device configured to ventilate the connecting line to the filler valve; and opening and closing of the filler valve for filling containers.

12. Method according to claim 11, further comprising:

detecting the fill level of a container to be filled; and closing the outlet from the mixing tank with the closing device when, on the basis of a detection result of the fill level detection step, it is determined that a predetermined fill quantity is present in the container which is equal to a nominal fill level of the container less the fill quantity present in the connecting line and the filler valve.

13. Method according to claim 11, further comprising:

producing a new mixing ratio of the media in the mixing tank by supply of just one of the at least two different media to the mixing tank when the outlet from the mixing tank is closed by the closing device.

14. Method according to claim 11, further comprising:

opening the outlet from the mixing tank with the closing device; and opening and closing the filler valve in a cycle with which containers are transported to the filler valve.

15. Plant comprising:

a device according to claim 2; and a transport device to transport the containers to the filler valve.

* * * * *